United States Patent [19]

Bulmer

[11] 4,295,358

[45] Oct. 20, 1981

[54] HYDRAULIC PRESS

[76] Inventor: J. Stewart Bulmer, 755 Fernhill Blvd., Oshawa, Ontario, Canada, L1J 5K2

[21] Appl. No.: 85,241

[22] Filed: Oct. 16, 1979

[51] Int. Cl.[3] ..... B21J 9/12

[52] U.S. Cl. ..... 72/453.06; 72/427; 72/453.18; 72/455; 100/214; 100/269 R

[58] Field of Search ..... 72/453.02, 453.01, 453.06, 72/453.18, 455, 427; 100/214, 269 R; 83/639, 125, 136

[56] References Cited

U.S. PATENT DOCUMENTS

| | | | |
|---|---|---|---|
| 5,635 | 10/1873 | Delkescamp | 83/125 |
| 2,257,294 | 9/1941 | Ernst | 100/214 |
| 2,603,988 | 7/1952 | Nowak | 72/427 |
| 2,790,399 | 4/1957 | Mayer | 83/125 |
| 3,596,499 | 8/1971 | Sauerbrey | 100/269 R |
| 3,686,952 | 8/1972 | Hitosugi | 72/427 |
| 3,908,496 | 9/1975 | Moeibert | 83/639 |

*Primary Examiner*—Gene P. Crosby

[57] ABSTRACT

A hydraulic trim press has a bed, stationary platen and a movable platen. The movable platen moves between the stationary platen and the bed on tie rods. The movable platen is driven by two spaced apart hydraulic cylinder and piston arrangements connected to a hydraulic circuit. A hydraulic tank for storage of hydraulic fluid is attached to the underside of the stationary platen. A manifold is secured to the top of the stationary platen to direct hydraulic fluid to the control valves and cylinders.

7 Claims, 4 Drawing Figures

HYDRAULIC PRESS

FIELD OF THE INVENTION

This invention relates to an improved hydraulic trim press and the like.

BACKGROUND OF THE INVENTION

It is the nature of hydraulic trim presses and the like to require high approach speed in order to minimize cycle time as well as high pressure at the end of the stroke to cut through the material being trimmed, pierced or pressed. In order to meet the foregoing requirements, elaborate hydraulic circuits have been developed in order to avoid the necessity of using oversized cylinders and increased oil flow rate. However, the elaborate hydraulic circuits, by necessity, require more complicated piping and valving arrangements which in turn are susceptible to increased incidence of oil leaks which in turn lead to excessive maintenance and down time.

The conventional trim press generally comprises a bed connected to a stationary platen by tie rods. A movable platen that is guided by the tie rods is actuated by a hydraulic cylinder mounted centrally of the stationary platen with the piston rod connected to the movable platen. The hydraulic cylinder is mounted above the stationary platen. Generally, there is an oil reservoir tank mounted near the hydraulic cylinder and in conventional presses it may surround the hydraulic cylinder or be positioned above the hydraulic cylinder or to one side of the hydraulic cylinder.

With the oil reservoir tank surrounding the cylinder, it naturally requires heavier steel material with the associated increase in cost. With the oil reservoir tank situated above the hydraulic cylinder, it increases the height of the press, thus making it undesirable in view of the increased height as well as being unstable. With the oil reservoir tank being mounted to one side of the hydraulic cylinder an inherent unstable situation is created and is therefore undesirable.

With the single hydraulic cylinder and piston system, as the piston is driven up and down, there is a great deal of bending moments created in the stationary platen due to the distance from the centre of the hydraulic piston to the extreme edges of the stationary platen, resulting in the need for the stationary platen to be of greater thickness. In other words, the maximum bending moment for the single hydraulic cylinder is the product of the full press tonnage acting at the centre of the longest span while the maximum bending moment for the present invention is the product of one-half of the tonnage acting at the centre of the shortest span.

Also with the single hydraulic cylinder and piston system, if the piston rod breaks it requires a separate safety system in order to prevent the press from falling down due to its own weight.

Further, with the single hydraulic cylinder and piston system it is not possible to put knock-out rods in the centre of the stationary platen.

It is, therefore, an object of the present invention to overcome the foregoing problems by providing a hydraulic trim press having two spaced apart hydraulic cylinder and piston system, a hydraulic tank for storage of hydraulic fluid attached to the underside of the stationary platen and located centrally thereof, and a solid metal manifold with holes drilled therethrough to conduct the hydraulic fluids to the control valves and cylinders in order to avoid the high pressure external hydraulic pipes as required in conventional presses as well as most other external pipes.

SUMMARY OF THE INVENTION

The present invention is directed to an improved hydraulic trim press and the like.

According to the invention, there is provided a hydraulic trim press comprising of a horizontal rectangular bed having four tie rods extending vertically upwardly from each corner of the bed. A movable rectangular platen parallel to the bed is slidably mounted on the tie rods to move towards and away from the bed. A stationary rectangular platen, which is also parallel to the bed, is connected to the ends of the tie rods at the opposite end from the bed. Two spaced apart hydraulic cylinders are secured to the underside of the stationary platen and extend vertically downward. The cylinders are located between the end tie rods. A piston rod extends outwardly from each of the cylinders and is connected to the movable platen. The pistons are driven through the length of the cylinder by hydraulic pressure. A hydraulic tank for storage of hydraulic fluid is attached to the underside of the stationary platen. A pump and a hydraulic circuit to drive the pistons is provided. A manifold secured to the top of the stationary platen directs the hydraulic fluid through the hydraulic circuit and directly into the cylinders. The control valves are bolted directly to the manifold to avoid the use of high pressure external pipes.

According to an aspect of the invention, the bottom of the hydraulic tank has means whereby the knock-out rods may strike against any portion of the bottom of the hydraulic tank.

And accordingly to a further aspect of the invention, the manifold is made of solid metal with holes drilled therethrough to conduct hydraulic fluid to the control valves, cylinders and back to the tank without the necessity of having high pressure external hydraulic piping.

BRIEF DESCRIPTION OF THE DRAWINGS

These and other objects, advantages and features of the invention will become apparent in the following detailed description of the preferred embodiment of the invention as shown in the drawings wherein.

DETAILED DESCRIPTION OF THE PREFERRED EMBODIMENTS OF THE INVENTION

Figure 1:
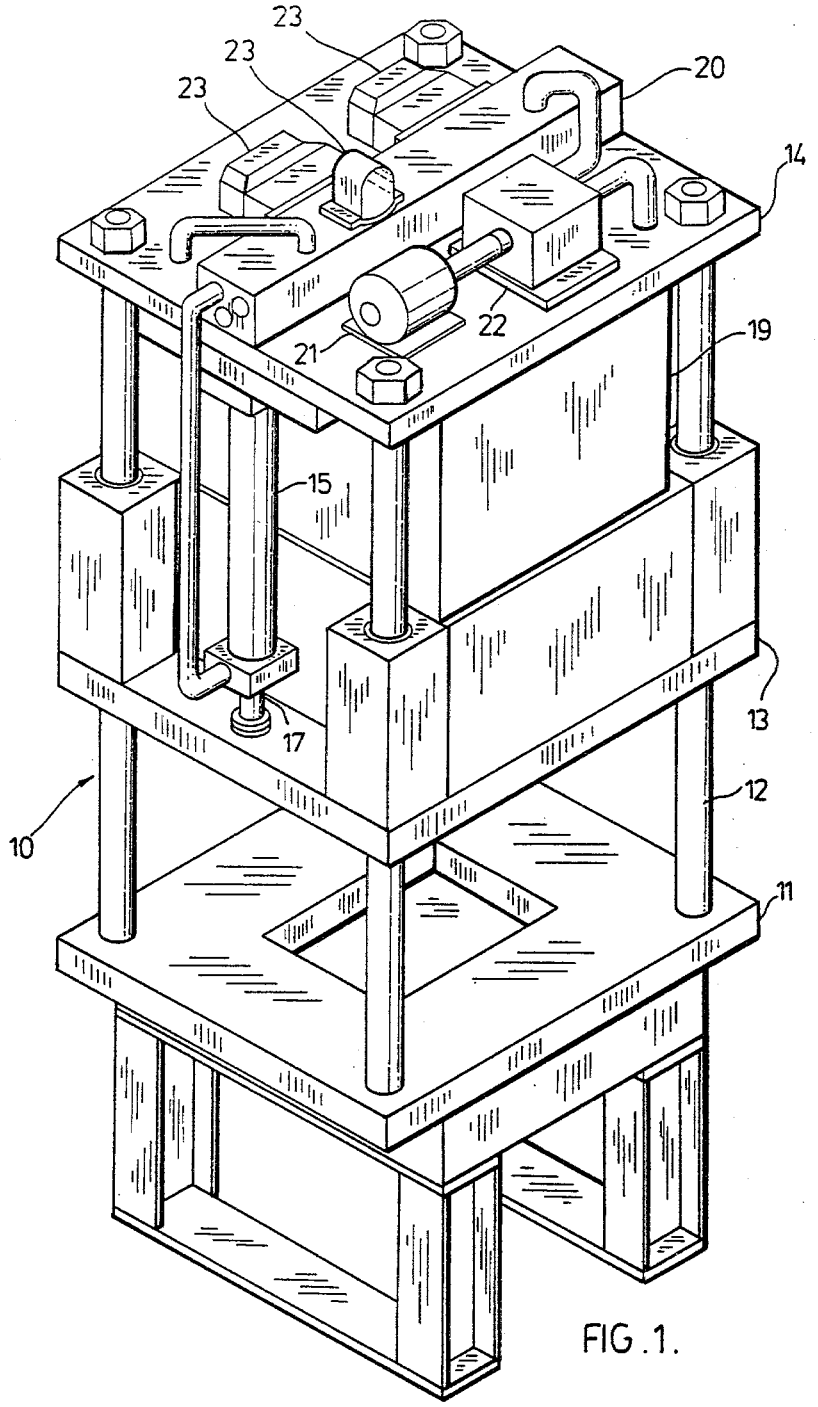
FIG. 1 is a perspective view of the hydraulic press.
Figure 2:
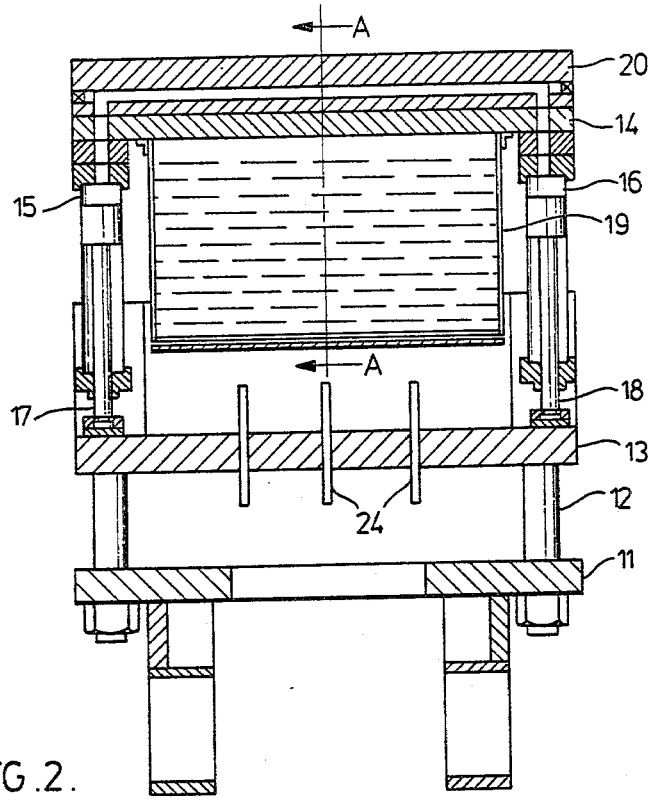
FIG. 2 is a cross-sectional view taken through the hydraulic cyinders.
Figure 3:
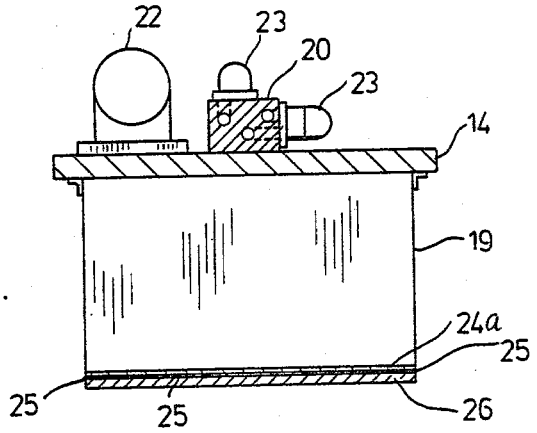
FIG. 3 is a cross-sectional view taken along line A—A of FIG. 2.

With reference to the drawings, there is shown a preferred embodiment of the invention. The hydraulic trim press generally designated as 10 comprises a bed 11, tie rods 12, a movable platen 13, and a stationary platen 14. The tie rods 12 are connected at one end to the bed 11 and at the opposite end to the stationary platen 14.

Attached to the underside of stationary platen 14 are hydraulic cylinders 15 and 16. The hydraulic cylinders 15 and 16 have piston rods 17 and 18 respectively extending outwardly from the cylinders 15 and 16. The piston rods 17 and 18 are connected to the movable platen 13.

Also connected to the underside of the stationary platen is a reservoir tank 19. The reservoir tank 19 is located centrally of the stationary platen 14.

Secured on top of stationary platen 14 is manifold 20 which is made of solid metal with holes drilled therein to provide the conduit for the hydraulic fluid from the reservoir 19 through to the hydraulic cylinders 15 and 16 and back to the reservoir 19. The hydraulic fluid is pumped by means of motor 21 and pump 22. Control valves 23 control the flow of hydraulic fluid through the hydraulic circuit. By having the fluid flow through the manifold 20 it avoids the necessity of having high pressure external hydraulic piping which could be a source of leaks.

At the underside of the reservoir 19 is located a knock-out area for knock-out rods 24 comprising a 3/16 inch steel plate 24*a* having a covering of ⅜-inch urethane 25 and a further ½-inch steel knock-out plate 26 on top of the urethane pad. Since the reservoir 19 is centrally located, the bottom of the reservoir tank becomes an ideal location for the knock-out rods to contact or strike.

With the two cylinder system, there is less bending moments caused in the stationary platen 14, thus reducing the thickness of the stationary platen.

With the reservoir 19 located on the underside of stationary platen 14 the centre of gravity for the entire machine is lowered, thus making the machine more stable as well as reducing the overall height.

With the two cylinder system, the machine is safer as compared to the single cylinder system in that there could be a failure of one cylinder rod without the movable platen 13 falling down and injuring the operator.

Figure 4:
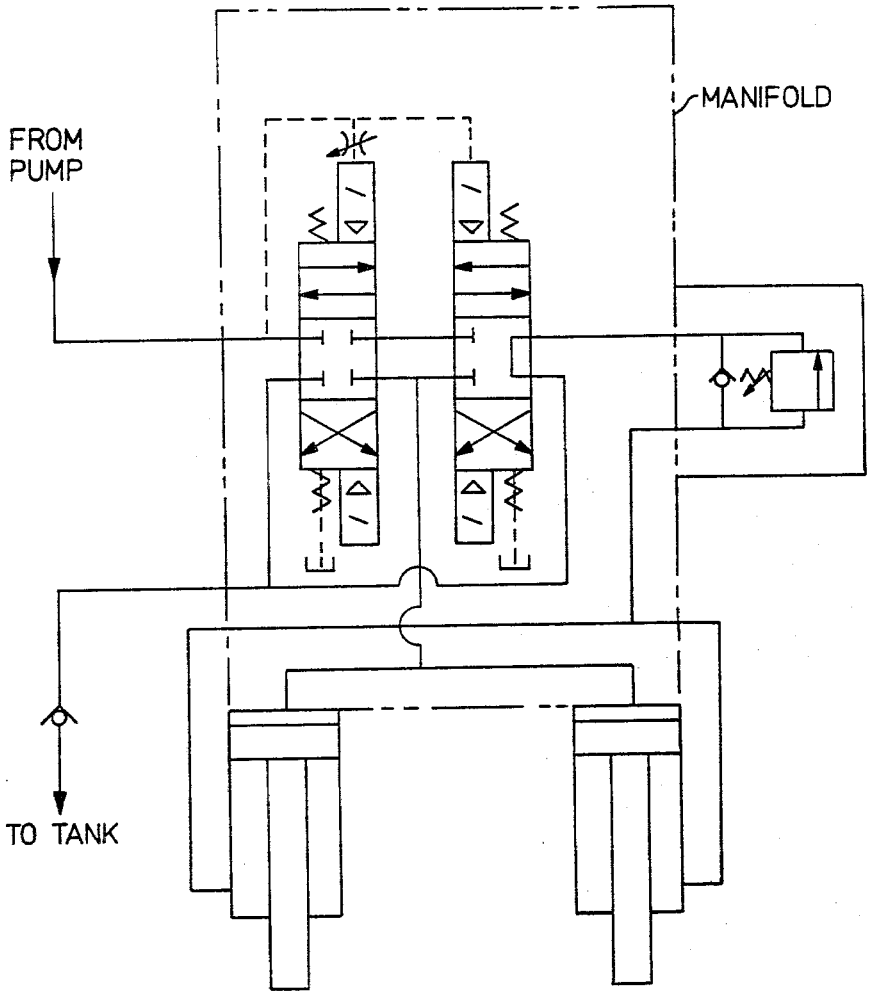
FIG. 4 is a schematic diagram of the hydraulic circuit.

FIG. 4 is a schematic diagram of the hydraulic circuit for the press. The circuit is known and is included in the description to provide information as to the method of operating and controlling the press.

Although a specific embodiment of the invention has been described herein in detail, it is understood that variations may be made thereto by those skilled in the art without departing from the spirit of the invention or the scope of the appended claim.

The embodiments of the invention in which an exclusive property or privilege is claimed are described as follows:

1. A hydraulic trim press comprising a horizontal rectangular bed; four tie rods extending vertically upwardly from each corner of said bed; a movable rectangular platen parallel to said bed and slidably mounted on said tie rods to move towards and away from said bed; a stationary rectangular platen parallel to said bed and connected to the end of said tie rods distal from said bed; two spaced apart hydraulic cylinders secured to said stationary platen and extending vertically downward, said cylinders located between the end tie rods with piston rods extending outwardly from each of said cylinders and connected to said movable platen, a hydraulic tank for storage of hydraulic fluid attached to the underside of said stationary platen, a means for driving said cylinders, a manifold secured on top of said stationary platen to direct hydraulic fluid to the control valves and cylinders.

2. A hydraulic trim press as claimed in claim 1 wherein the bottom of said hydraulic tank has means for contacting knock-out rods over the complete area of the bottom of said hydraulic tank.

3. A hydraulic trim press as claimed in claim 2 wherein said manifold is made of solid metal with holes drilled therethrough to conduct hydraulic fluid to the said control valves and cylinders and back to said tank.

4. A hydraulic trim press as claimed in claim 1 wherein said manifold is made of solid metal with holes drilled therethrough to conduct hydraulic fluid to said control valves and cylinders and back to said tank.

5. A hydraulic trim press as claimed in claim 2 wherein said means for contacting knock-out rods comprises an urethane pad sandwiched by two steel plates.

6. A hydraulic trim press as claimed in claim 3 wherein said means for contacting knock-out rods comprises an urethane pad sandwiched by two steel plates.

7. A hydraulic trim press as claimed in claim 4 wherein said control valves are connected directly to said manifold.

* * * * *